US007506880B2

(12) United States Patent
Burwell

(10) Patent No.: US 7,506,880 B2
(45) Date of Patent: Mar. 24, 2009

(54) BAMBOO CORE HYBRID SKATEBOARD DECK

(76) Inventor: Scott Burwell, 1313 Calle Avasyzado, San Clemente, CA (US) 92673

( * ) Notice: Subject to any disclaimer, the term of this patent is extended or adjusted under 35 U.S.C. 154(b) by 0 days.

(21) Appl. No.: 11/810,186

(22) Filed: Jun. 4, 2007

(65) Prior Publication Data

US 2008/0296858 A1 Dec. 4, 2008

Related U.S. Application Data

(63) Continuation-in-part of application No. 11/796,319, filed on Apr. 26, 2007.

(60) Provisional application No. 60/795,949, filed on Apr. 28, 2006.

(51) Int. Cl.
*B62M 1/00* (2006.01)

(52) U.S. Cl. ..... 280/87.042; 280/87.01; 280/87.03

(58) Field of Classification Search ..... 280/87.01, 280/87.021, 97.03, 87.041, 87.042, 87.043
See application file for complete search history.

(56) References Cited

U.S. PATENT DOCUMENTS 6,182,986 B1 * 2/2001 Smith ..... 280/87.042
6,386,561 B1 * 5/2002 Hanson ..... 280/87.042
6,460,868 B2 * 10/2002 Madrid ..... 280/87.042
6,648,363 B2 * 11/2003 Gordon ..... 280/610
6,854,748 B2 * 2/2005 Wimbish et al. ..... 280/87.042
6,916,261 B2 7/2005 Cullen et al. ..... 473/563
7,044,486 B2 * 5/2006 Wright et al. ..... 280/87.042
2004/0188967 A1 * 9/2004 Gallo ..... 280/87.041
2004/0222609 A1 * 11/2004 Schmitt ..... 280/87.042
2005/0121881 A1 * 6/2005 Ambuske ..... 280/610

* cited by examiner

*Primary Examiner*—Christopher P Ellis
*Assistant Examiner*—John D Walters
(74) *Attorney, Agent, or Firm*—Paul J. Backafen, Esq.; Crockett & Crockett

(57) ABSTRACT

A hybrid skateboard deck combines at least one layer of bamboo with one or more layers of any suitable wood to form a multi-ply deck. A hybrid skateboard deck combines at least one layer of bamboo sandwiched between at least two layers of conventional hardwood such as maple. The addition of a bamboo layer in the core of the laminated deck provides superior strength relative to conventional plywood decks. The bamboo core laminate also provides superior feedback to a rider as well as uniform stiffness.

4 Claims, 6 Drawing Sheets

BAMBOO CORE HYBRID SKATEBOARD DECK

RELATED APPLICATIONS

This application is a continuation-in-part of copending U.S. application Ser. No. 11/796,319 filed Apr. 26, 2007 which claims priority from U.S. provisional patent application 60/795,949 filed Apr. 28, 2006.

FIELD OF THE INVENTIONS

The inventions described below relate to the field of sporting goods and more specifically to skateboard deck composition.

BACKGROUND OF THE INVENTIONS

Conventional skateboard deck composition began with single layer wood panels and evolved to high technology composites as well as metal composite combinations. The currently preferred decks are formed of layers of maple and or birch.

SUMMARY

Bamboo is a natural material that has many suitable properties, however it is not been used in plywood because bamboo may not be peeled to form thin layers as is done with wood. Bamboo is a grass and must be cut into thin strips and the strips arranged parallel to each other and glued together to form a thin layer of parallel strips. Historically, this process has not yielded suitable layers for laminating. If these layers are used on the top or bottom of a laminated skateboard deck they are highly susceptible to delamination and do not impart uniform stiffness or flex to a skateboard deck.

A bamboo core hybrid skateboard deck includes a layer composed of a bamboo core and a wood perimeter element. The bamboo core provides the stiffness and feel between the truck attachment points and the wood perimeter provides abrasion resistance. One or more bamboo core layers may be used in a hybrid core for a skateboard deck.

A hybrid skateboard deck combines at least one layer of bamboo with one or more layers of any suitable wood to form a multi-ply deck. Any suitable selection and arrangement of wood layers may be combined with the one or more layers of bamboo to form a hybrid skateboard deck.

A hybrid deck may have from two to ten layers or ply's that may be formed of any suitable wood or combinations of wood. The layers may be joined using any suitable technique and any suitable adhesive, resin, glue or other material.

A hybrid skateboard deck combines at least one layer of bamboo sandwiched between at least two layers of conventional hardwood such as maple. The addition of a bamboo layer in the core of the laminated deck provides superior strength relative to conventional plywood decks. The bamboo core laminate also provides superior feedback to a rider as well as uniform stiffness.

A hybrid skateboard deck combines outer layers of conventional wood with a multi-layer hybrid core. The outer layers, top and bottom layers, may be formed of any suitable wood such as maple. The hybrid core may be formed of at least one layer of bamboo.

DETAILED DESCRIPTION OF THE INVENTIONS

Figure 1:
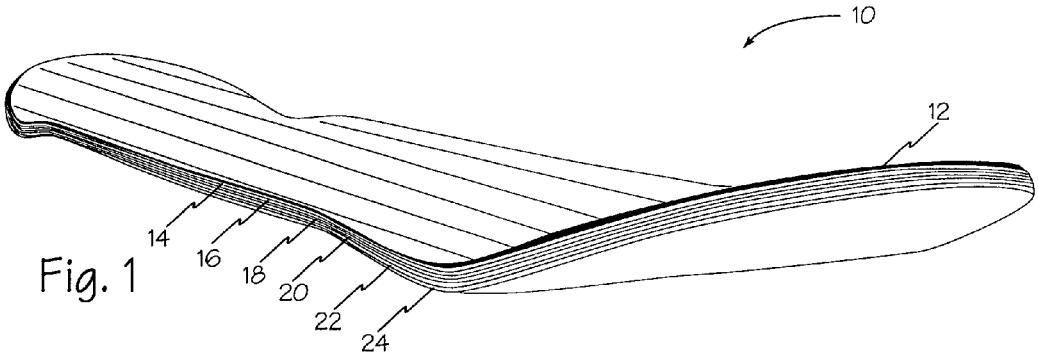
FIG. 1 is a perspective view of a seven-layer hybrid deck according to the present disclosure.

Hybrid deck 10 of FIG. 1 includes at least one bamboo layer such as bamboo layer 12 combined with one or more other layers of any suitable wood such as layers 14, 16, 18, 20, 22, and 24. Bamboo layer 12 may be any layer of the deck. The additional layers, wood layers 14, 16, 18, 20, 22, and 24, may be any other suitable wood or combinations of wood such as but not limited to maple, birch, beech, cherry, elm, gum, hickory and or mesquite. For example a seven-layer deck may include a bamboo layer, two maple layers, another bamboo layer, two birch layers and a mesquite layer. The process of laminating the layers to form a skateboard deck may employ any suitable technique, and any suitable glue, resin or other adhesive and or filler to form a suitable multi-layer deck.

Figure 2:
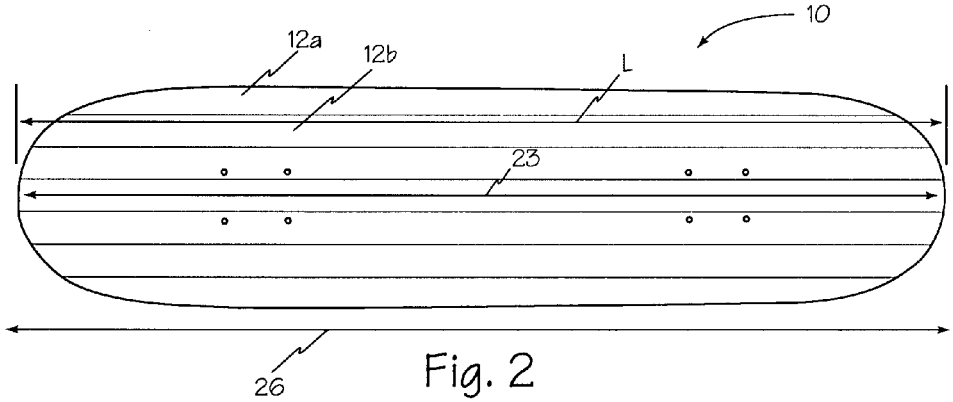
FIG. 2 is a top view of the deck of FIG. 1.
Figure 3:
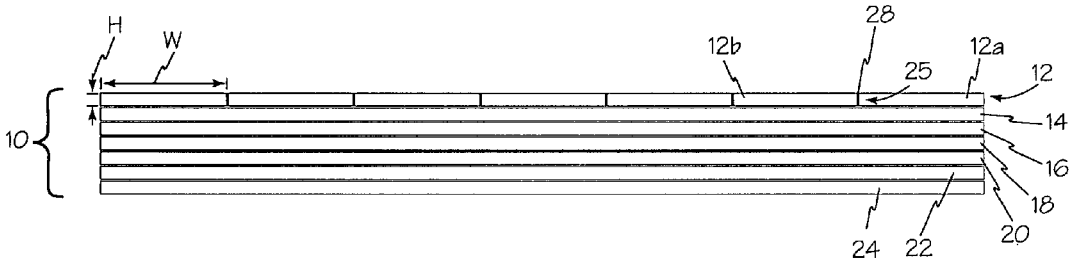
FIG. 3 is an end view of the deck of FIG. 1.

Referring now to FIG. 2 and FIG. 3, bamboo layer 12 may be formed of two or more strips of bamboo having at least length L, a width W from edge to edge, and a height or thickness H. Joining multiple parallel strips together forms a strip axis 23. The strips are joined along generally parallel edges such as edges 25 to form a thin layer with the bamboo grain parallel to strip axis 23, and in this example also parallel to long axis 26 of deck 10. Joints between bamboo strips such as joint 28 may be formed using any suitable technique.

Figure 4:
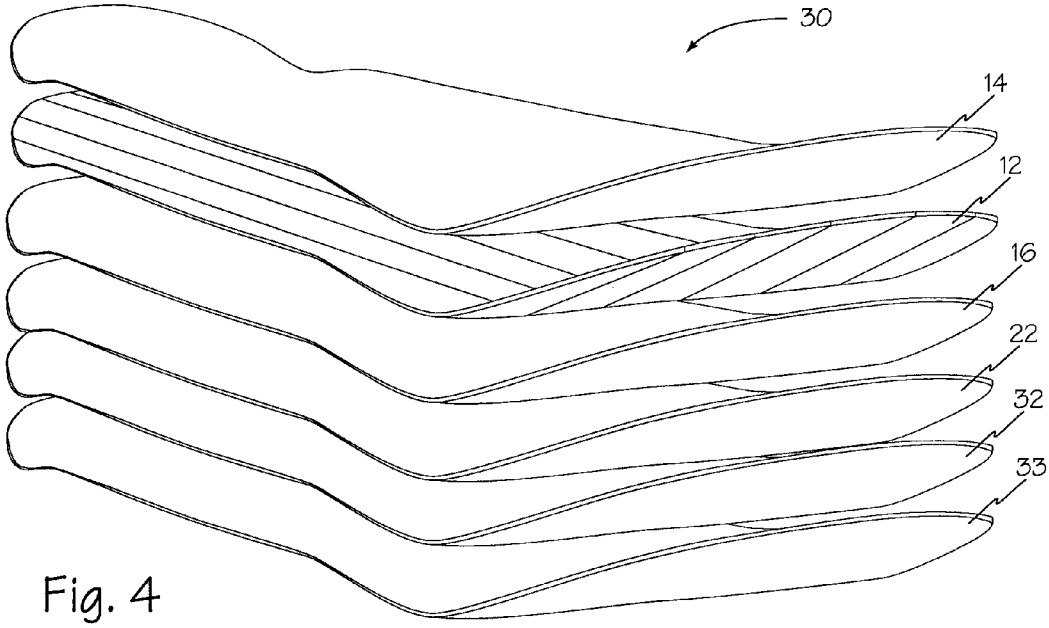
FIG. 4 is an exploded view of a six-layer deck according to the present disclosure.

Referring now to FIG. 4, hybrid skateboard deck 30 may be composed of any suitable combination of woods and or other materials such as bamboo, metal or man-made composites. In deck 30 bamboo layer 12 is the second layer from the top and the top layer is maple layer 14. Maple layer 16 is below bamboo layer 12. Birch layer 22 is supported by hickory layer 32 and mesquite layer 33. In this example bamboo layer 12 has the strip axis oriented parallel to the long axis of the deck.

Figure 5:
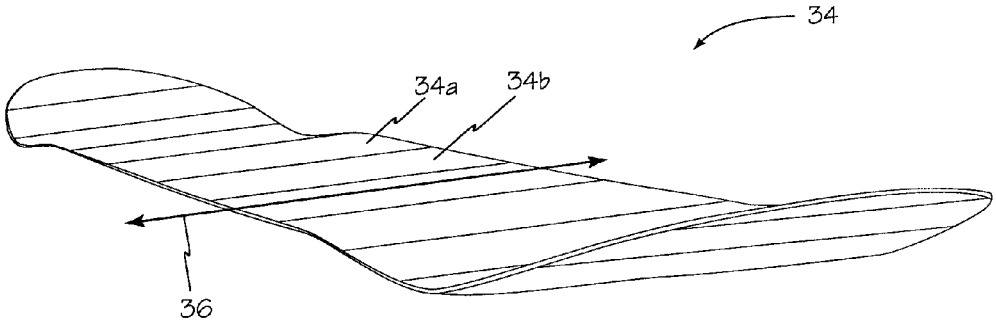
FIG. 5 is a perspective view of an alternate bamboo layer according to the present disclosure.

Referring now to FIG. 5, alternate bamboo layer 34 may be used in a hybrid deck such as deck 10 or deck 30 as an alternative to bamboo layer 12, or in addition to bamboo layer 12. Bamboo strips such as bamboo strips 34*a* and 34*b* are oriented with grain of the strips and thus the strip axis 36 perpendicular to long axis 26.

Figure 6:
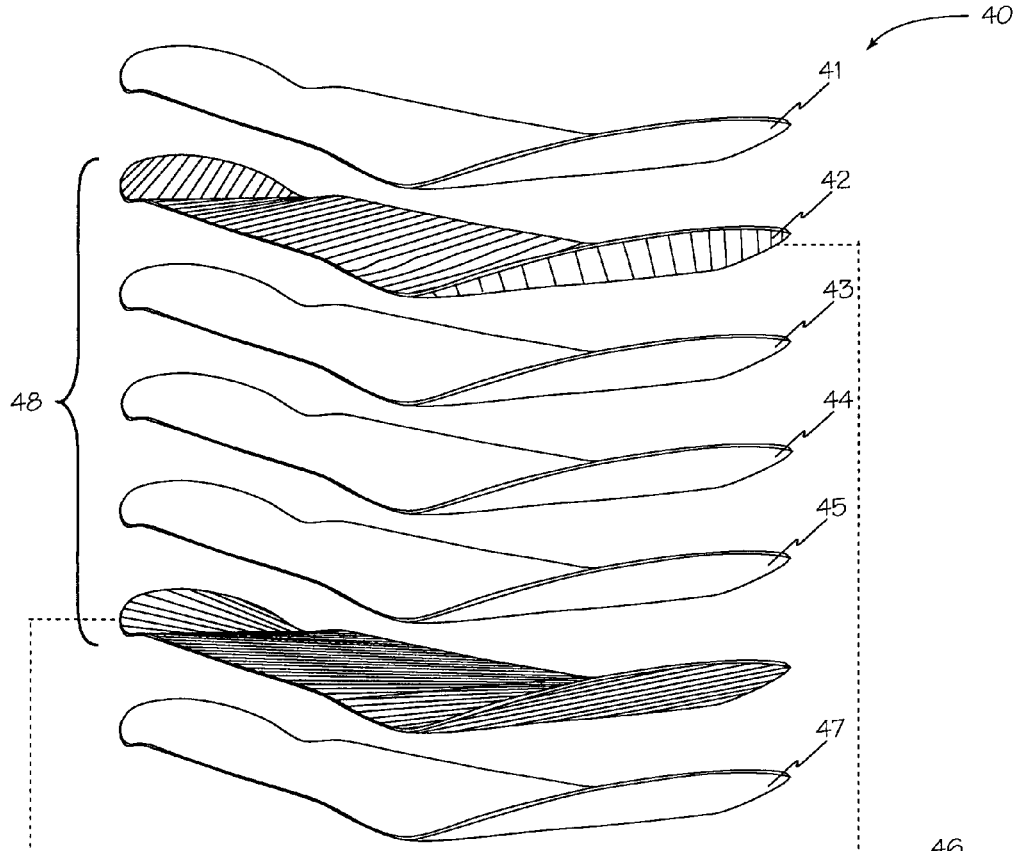
FIG. 6 is an exploded view of an alternate seven-layer deck according to the present disclosure.

Referring now to FIG. 6, hybrid deck 40 includes top and bottom wood layers 41 and 47 surrounding hybrid core 48. Hybrid core may include one or more layers of material other than wood such as bamboo, metal or other man-made materials such as carbon composites or other material. In this example, hybrid core 48 includes bamboo layers 42 and 46 and wood layers 43, 44 and 45. As discussed above the variety of material layers may be arranged into a stack in any suitable order to achieve desired performance and strength.

Figure 6A:
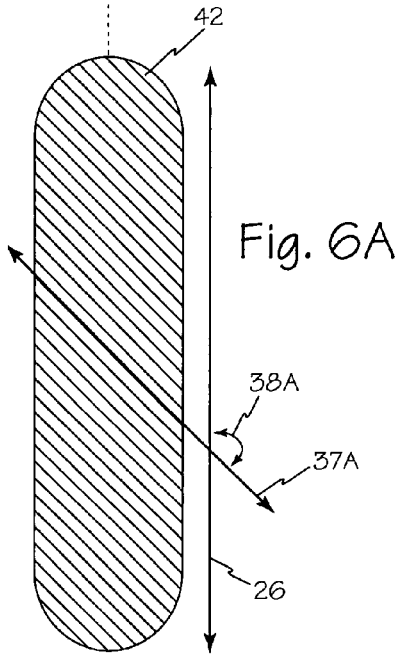
Figure 6B:
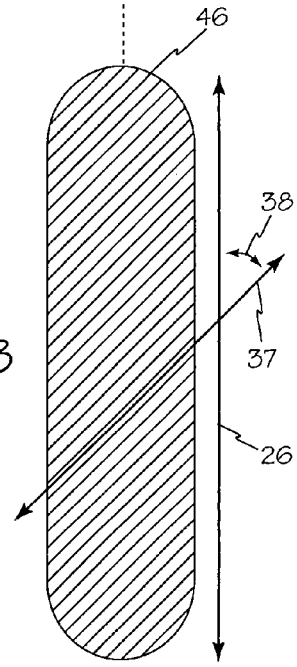

As illustrated in FIGS. 6A and 6B any other suitable orientations of a strip axis may also be used such as orienting strip axis 37 to form acute angle 38 relative to long axis 26 as shown for bamboo layer 46 which may be described as a left slope layer. Alternatively, in bamboo layer 42 which may be described as a right slope layer, strip axis 37A may form an obtuse angle 38A relative to long axis 26.

Figure 7:
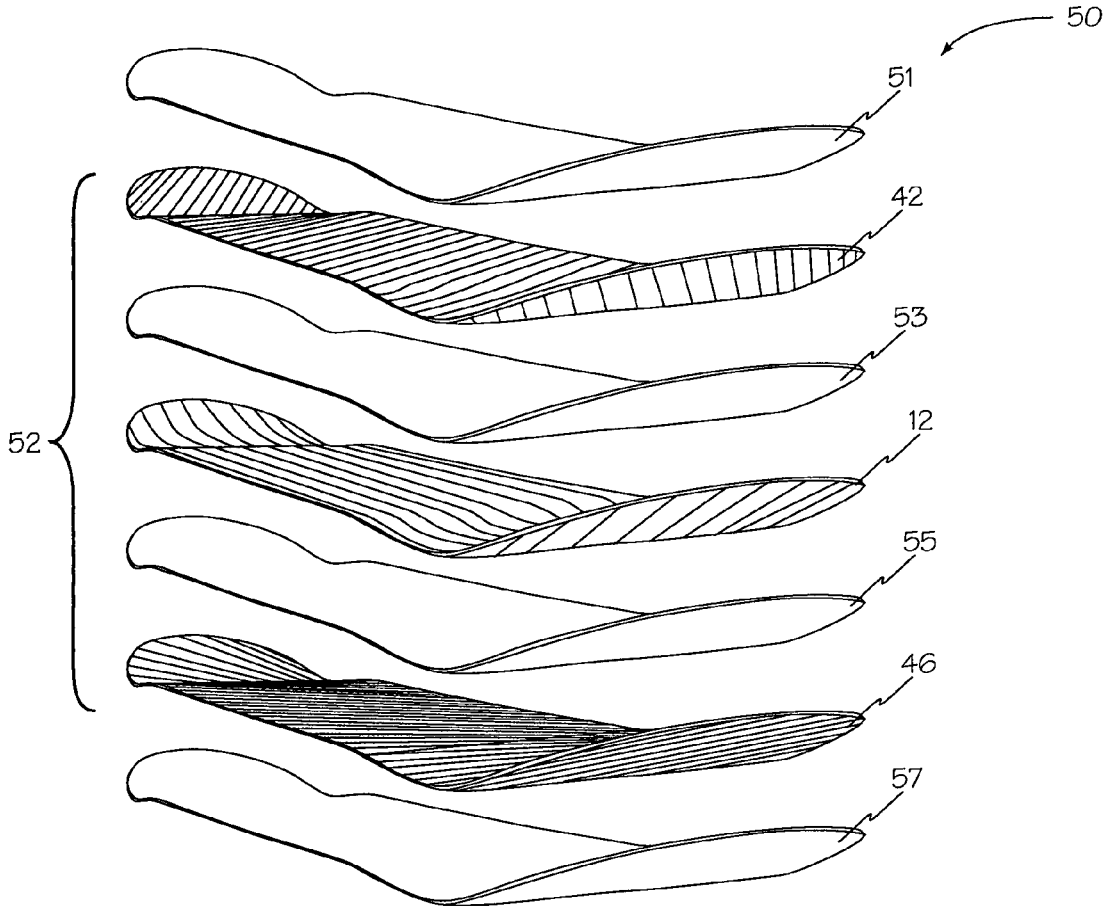
FIG. 7 is an exploded view of another alternate seven-layer deck according to the present disclosure.

Referring now to FIG. 7, hybrid skateboard deck 50 includes outer layers of conventional wood surrounding hybrid core 52. Top layer 51 and bottom layer 58 may be formed of any suitable wood. Hybrid core 52 includes left slope bamboo layer 42, straight bamboo layer 12 and right slope bamboo layer 46 with other material layers such as layer 53 and bottom layer 55.

Figure 8:
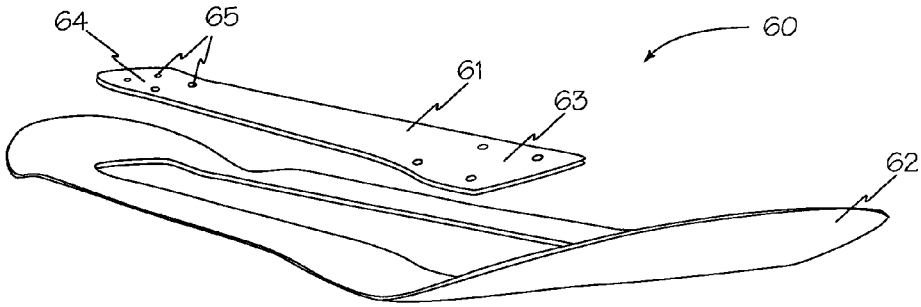
FIG. 8 is an exploded view of a bamboo core layer.

A single layer suitable for inclusion in a multi-ply skateboard deck may combine two or more dissimilar materials such as bamboo and wood, or fiberglass and wood, carbon composite material and wood, metal and wood or any suitable combination. In FIG. 8, bamboo core layer 60 includes bamboo core 61 surrounded by wood perimeter element 62. Wood perimeter element 62 may be formed from any suitable wood. A bamboo core such as bamboo core 61 extends from at least front truck connection 63 to rear truck connection 64 and includes multiple holes such as holes 65 for securing the front and rear trucks to engage bamboo core 61.

Figure 9:
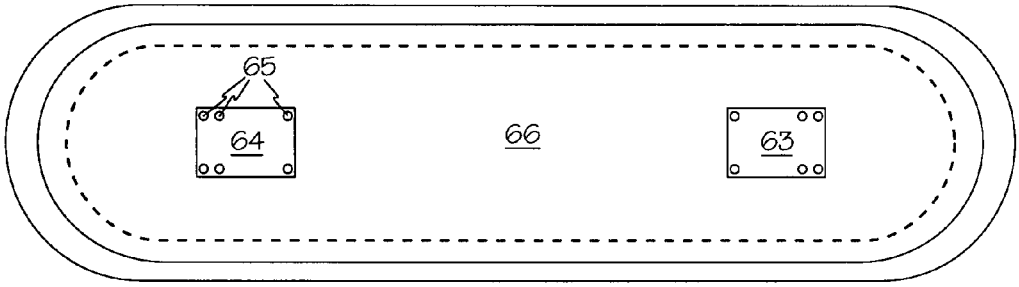
FIG. 9 is a top view of a first bamboo core layer.
Figure 10:
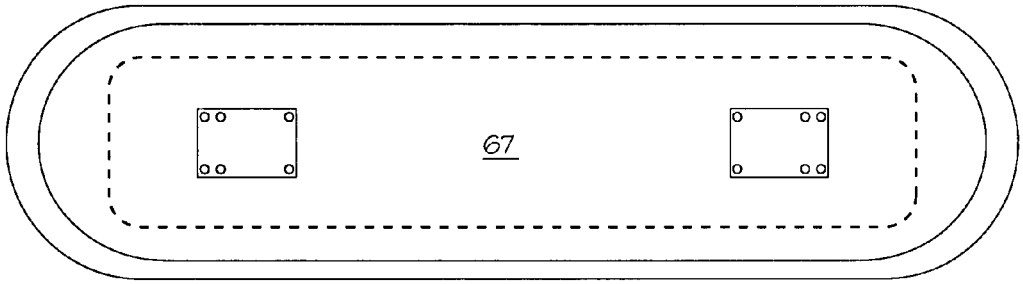
FIG. 10 is a top view of an alternate bamboo core layer.

Referring now to FIGS. 9 and 10, bamboo cores 66 and 67 illustrate two possible shapes for bamboo cores, any other suitable shapes may be used. Bamboo cores should at least extend to include the front and rear truck connections such as connections 63 and 64.

Figure 11:
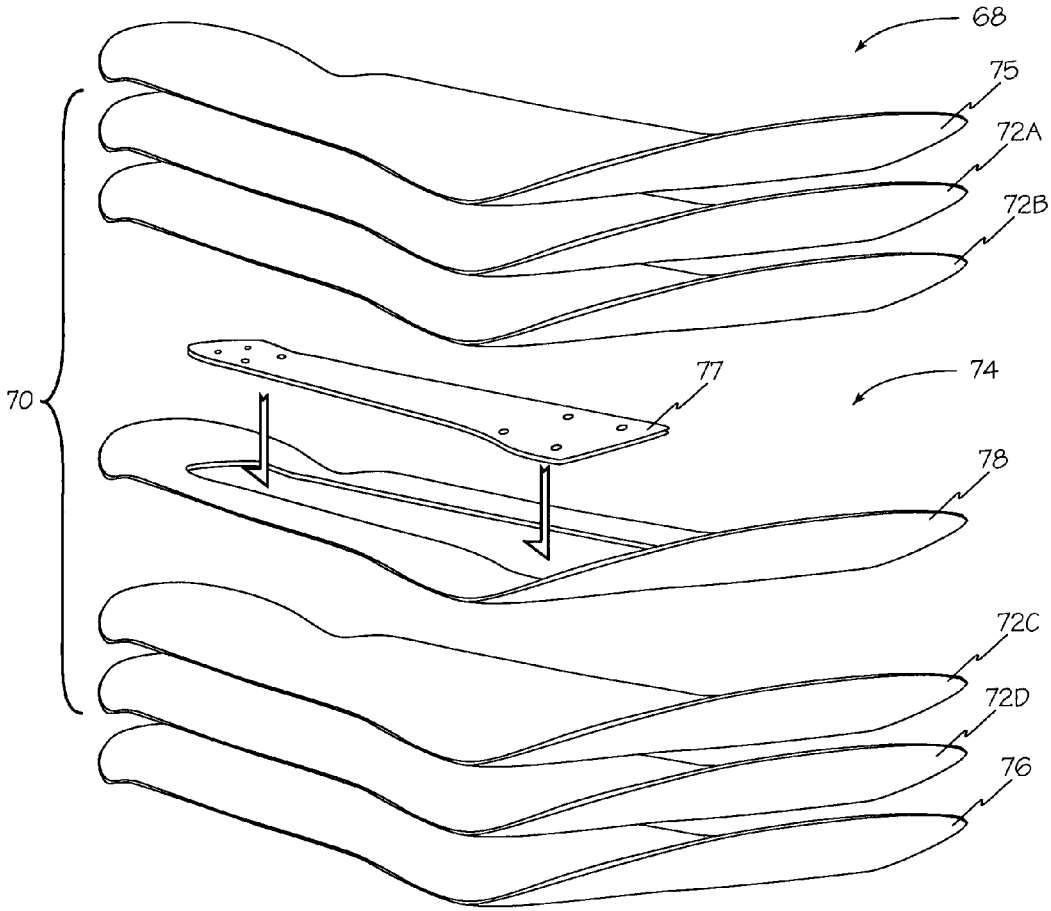
FIG. 11 is an exploded view of a hybrid skateboard deck including a bamboo core layer.

Hybrid skateboard deck 68 of FIG. 11 includes hybrid core 70 which may include two or more dissimilar layers such as one or more of wood layers 72A, 72B, 72C, and 72D and bamboo core layer 74. Upper and lower deck layers 75 and 76 respectively may be made of any suitable wood. Bamboo core layer is formed of bamboo core element 77 and wood perimeter element 78.

While the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A hybrid skateboard deck comprising:

an upper wood layer;

a lower wood layer; and a bamboo core layer between the upper layer and the lower layer, the bamboo core layer having two or more coplanar elements including a bamboo core element and a wood perimeter element.

2. The skateboard deck of claim 1 further comprising:

a hybrid core between the upper and lower layers, the hybrid core having at least three layers of material with at least one bamboo core layer.

3. The skateboard deck of claim 1 wherein the wood layers are formed of one or more woods selected from maple, birch, beech, cherry, elm, gum, hickory and mesquite.

4. The skateboard deck of claim 3 wherein the hybrid core further comprises five layers of material with at least one bamboo core layer.

* * * * *

UNITED STATES PATENT AND TRADEMARK OFFICE

CERTIFICATE OF CORRECTION

PATENT NO. : 7,506,880 B2
APPLICATION NO. : 11/810186
DATED : March 24, 2009
INVENTOR(S) : Scott Burwell It is certified that error appears in the above-identified patent and that said Letters Patent is hereby corrected as shown below:

Title page, Item [75] should read as follows:

Inventor: “Avanzado”

Title page, Item 74, should read as follows:

Attorney, Agent of Firm: Replace [Backafen] with “Backofen”

Signed and Sealed this

Twenty-eighth Day of April, 2009

John Doll

JOHN DOLL
*Acting Director of the United States Patent and Trademark Office*